United States Patent [19]

Arakawa et al.

[11] Patent Number: 4,791,009

[45] Date of Patent: Dec. 13, 1988

[54] PROCESS FOR THE PREPARATION OF RADIATION IMAGE STORAGE PANEL

[75] Inventors: Satoshi Arakawa, Minami-ashigara; Yuichi Hosoi, Chigasaki; Hisashi Yamazaki, Kanagawa; Yoshiteru Ito, Minami-ashigara, all of Japan

[73] Assignee: Fuji Photo Film Co., Ltd., Minami-ashigara, Japan

[21] Appl. No.: 71,084

[22] Filed: Jul. 8, 1987

[30] Foreign Application Priority Data

Jul. 9, 1986 [JP] Japan ..... 61-161733

[51] Int. Cl.[4] ..... B28B 1/14; B05D 5/06

[52] U.S. Cl. ..... 427/64; 264/299; 264/360; 264/319; 264/331.11; 427/67; 427/407.2; 427/419.2; 427/419.1; 427/419.5

[58] Field of Search ..... 427/64, 67, 419.2, 419.5, 427/419.1, 407.2; 264/319, 300, 299, 331.11

[56] References Cited

U.S. PATENT DOCUMENTS

| | | | |
|---|---|---|---|
| 4,058,639 | 11/1977 | Schreurs | 427/67 |
| 4,292,107 | 9/1981 | Tanaka et al. | 427/64 |
| 4,308,186 | 12/1981 | Schreurs et al. | 427/67 |
| 4,551,356 | 11/1985 | Heiz | 427/64 |

*Primary Examiner*—Janyce Bell

*Attorney, Agent, or Firm*—Gerald J. Ferguson, Jr.

[57] ABSTRACT

A process for the preparation of a radiation image storage panel which comprises a support, a light-reflecting layer and a stimulable phosphor layer, superposed in this order, characterized in that applying a binder solution-I containing a light-reflecting material and a binder solution-II containing a stimulable phosphor onto a surface of a support or a sheet in such a manner that both the binder solutions are superposed, to form a light-reflecting layer and a stimulable phosphor layer simultaneously.

16 Claims, No Drawings

PROCESS FOR THE PREPARATION OF RADIATION IMAGE STORAGE PANEL

BACKGROUND OF THE INVENTION

1. Field of the Invention

The present invention relates to a process for the preparation of a radiation image storage panel employed in a radiation image recording and reproducing method utilizing a stimulable phosphor. More particularly, the invention relates to a process for the preparation of a radiation image storage panel comprising a support, a light-reflecting layer and a stimulable phosphor layer, superposed in this order.

2. Description of the Prior Art

For obtaining a radiation image, there has been recently proposed and practically used a radiation image recording and reproducing method utilizing a stimulable phosphor as described, for instance, in U.S. Pat. No. 4,239,968. In the method, a radiation image storage panel (i.e., stimulable phosphor sheet) comprising a stimulable phosphor is used, and the method involves steps of causing the stimulable phosphor of the panel to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (stimulated emission); photoelectrically detecting the emitted light to obtain electric signals; and reproducing the radiation image of the object as a visible image from the electric signals.

In the radiation image recording and reproducing method, a radiation image is obtainable with a sufficient amount of information by applying a radiation to the object at considerably smaller dose, as compared with the conventional radiography. Accordingly, this method is of great value especially when the method is used for medical diagnosis.

The radiation image storage panel employed in the above-described method has a basic structure comprising a support and a stimulable phosphor layer provided on one surface of the support. Further, a transparent film is generally provided on the free surface (surface not facing the support) of the phosphor layer to keep the phosphor layer from chemical deterioration or physical shock.

The stimulable phosphor layer comprises a binder and stimulable phosphor particles dispersed therein. The stimulable phosphor emits light (gives stimulated emission) when excited with stimulating rays such as visible light or infrared rays after having been exposed to a radiation such as X-rays. Accordingly, the radiation having passed through an object or having radiated from an object is absorbed by the phosphor layer of the panel in proportion to the applied radiation dose, and a radiation image of the object is produced in the panel in the form of a radiation energy-stored image. The radiation energy-stored image can be released as stimulated emission by sequentially irradiating (scanning) the panel with stimulating rays. The stimulated emission is then photoelectrically detected to give electric signals, so as to reproduce a visible image from the electric signals.

The radiation image recording and reproducing method is very useful for obtaining a radiation image as a visible image as described hereinbefore, and it is desired for the radiation image storage panel employed in the method to have a high sensitivity and provide an image of high quality (high sharpness, high graininess, etc.), as well as a radiographic intensifying screen employed in the conventional radiography.

For enhancing the sensitivity of the radiation image storage panel, there has been known the art that a light-reflecting layer is provided between the support and the stimulable phosphor layer by depositing a metal such as aluminum, etc. on the surface of the support, laminating a metal foil such as an aluminum foil thereon, or applying a coating dispersion comprising a binder and a light-reflecting material thereonto. As for the light-reflecting material, titanium dioxide, white lead, zinc sulfide, aluminum oxide, magnesium oxide and alkaline earth metal fluorohalides are employed as described in U.S. patent application Ser. No. 586,691 now U.S. Pat. No. 4,229,968. A light emitted by the stimulable phosphor in the phosphor layer and advancing towards the support is reflected by said layer and released from the phosphor layer-side surface of the panel. Accordingly, the light advancing towards the support is also detected to enhance the sensitivity of the panel.

However, there is a problem that air bubbles are apt to occur on the interface between the light-reflecting layer and the stimulable phosphor layer in the course of forming them by coating the support successively with a coating dispersion comprising a binder and a light-reflecting material and a coating dispersion comprising a binder and a stimulable phosphor (i.e., successive coating method), and the bubbles affect a resulting image to cause lowering of image quality (unevenness of image density). The occurring of bubbles is presumed to result from that a solvent in a coating dispersion for the phosphor layer permeates the light-reflecting layer when applying the coating dispersion thereonto and makes air dispersively contained in the light-reflecting layer rise to the surface thereof to be concentrated thereon.

There has been proposed a method of simultaneously forming a stimulable phosphor layer and a protective film (or a single phosphor layer which also serves as a protective film in the case of both binders being compatible with each other) on the support by simultaneously coating a binder solution containing a stimulable phosphor and a binder solution containing no stimulable phosphor in a superposed form, as described in U.S. patent application Ser. No. 771,122 now U.S. Pat. No. 4,728,583. This superposition-coating method brings about simplification of a process for the preparation of a panel and enhancement of adhesion between the phosphor layer and the protective film. Further, nonexistence of an adhesive agent therebetween prevents the stimulating rays and the emitted light from being reflected by each interface between the phosphor layer, the adhesive layer and the protective film, to enhance sensitivity and image quality.

SUMMARY OF THE INVENTION

An object of the present invention is to provide a process for the preparation of a radiation image storage panel which provides an image having no unevenness of image density (no lowering of image quality) and has high sensitivity.

Another object of the present invention is to provide a process for the preparation of a radiation image storage panel which has high sensitivity and provides an image improved in the quality.

The objects can be accomplished in the first aspect by a process for the preparation of a radiation image storage panel which comprises a support, a light-reflecting layer and a stimulable phosphor layer, superposed in this order, characterized in that applying a binder solution-I containing a light-reflecting material and a binder solution-II containing a stimulable phosphor onto a surface of a support in such a manner that both the binder solutions are superposed and the binder solution-I is arranged on the support side, to form a light-reflecting layer and a stimulable phosphor layer simultaneously.

The objects can be accomplished in the second aspect by a process for the preparation of a radiation image storage panel which comprises a support, a light-reflecting layer and a stimulable phosphor layer, superposed in this order, characterized in that:

applying a binder solution-I containing a light-reflecting material and a binder solution-II containing a stimulable phosphor onto a surface of a plane sheet in such a manner that both the binder solutions are superposed and the binder solution-II is arranged on the sheet side, to form a stimulable phosphor layer and a light-reflecting layer simultaneously; and separating both the layers from the sheet and combining the layers and a support in such a manner that the light-reflecting layer faces the support.

In the present specification, the term "forming two or more layers simultaneously by coating in a superposed form" (i.e., simultaneous superposition-coating) means that two or more of coating dispersions are applied onto a sheet at a time in such a manner that the coating dispersions are superposed and then dried, or that the coating dispersions are immediately applied on a sheet one after another and then dried together. When binders contained in the coating dispersions are compatible with each other, an interface between a light-reflecting layer and a stimulable phosphor layer is not always clear in a radiation image storage panel prepared according to the process of the present invention.

In the light-reflecting layer, light emitted by a stimulable phosphor in the phosphor layer is reflected by boundary surfaces between a light-reflecting material and other material surrounding it, to contribute the sensitivity of the radiation image storage panel. The reflection properties of said layer, which are an aimed effect, depend upon the difference between a refractive index of the light-reflecting material and that of the surrounding material. Usually, the light-reflecting layer contains air dispersed particulately in addition to the particles of light-reflecting material. The refractive index of the light-reflecting material is generally in the range of approx. 1.5–2.2, while that of air is 1.0 and that of the binder composed of a polymer material is in the range of approx. 1.4–1.6. The emitted light is more effectively reflected by the interfaces between the light-reflecting material and air, so that it is important that the light-reflecting layer sufficiently contains air dispersively.

Usually, air is incorporated into the light-reflecting layer together with the particles of light-reflecting material during the formation thereof. As the amount of the light-reflecting material contained in the layer is increased (and the amount of the binder is decreased), air bubbles are liable to be concentrated on the interface between said layer and the stimulable phosphor layer, owing to the permeation of the solvent in the coating dispersion during the formation of the phosphor layer in the conventional successive coating method in which both layers are formed independently. These air bubbles cause the unevenness of density of an image provided by the panel to lower the image quality.

According to the process for the preparation of the present invention, air bubbles are not concentrated on the interface between the light-reflecting layer and the stimulable phosphor layer, even when the large amount of the light-reflecting material is contained in the coating dispersion, because both layers of the coating dispersions for the light-reflecting layer and the phosphor layer are dried at the same time. The image quality is not affected. This means that the emitted light is effectively reflected by the boundary surfaces between the light-reflecting material and air which is kept dispersively in the light-reflecting layer without aggregating on the interface.

Further, since the large amount of the light-reflecting material can be contained in the light-reflecting layer, the reflection properties thereof are improved to give a panel of the high sensitivity even when the thickness of the stimulable phosphor layer is reduced. The panel also provides an image of high quality.

In addition to these advantages, it is not necessary to conduct the coating and drying procedure individually for the formation of the light-reflecting layer and the stimulable phosphor layer, which has been required in conventional, so as to simplify the process for the preparation of the panel. It is also possible to enhance the adhesion therebetween.

DETAILED DESCRIPTION OF THE INVENTION

The radiation image storage panel having the above-described advantages can be prepared, for instance, by the following process according to the present invention.

A light-reflecting layer and a stimulable phosphor layer are formed by the simultaneous superposition-coating method, which is a characteristic requisite of the invention. The light-reflecting layer comprises a binder and particles of a light-reflecting material dispersed therein. The stimulable phosphor layer comprises a binder and stimulable phosphor particles dispersed therein.

In the first place, a coating dispersion-I in which a particulate light-reflecting material is homogeneously dispersed in a binder solution is prepared for the formation of the light-reflecting layer.

Examples of the light-reflecting material include white pigments such as $Al_2O_3$, $ZrO_2$, $TiO_2$, $BaSO_4$, $SiO_2$, ZnS, ZnO, MgO, $CaCO_3$, $Sb_2O_3$, $Nb_2O_5$, $2PbCO_3.Pb(OH)_2$, $M^{II}FX$ (wherein $M^{II}$ is at least one element selected from the group consisting of Ba, Ca and Sr; and X is Cl and/or Br), lithopone ($BaSO_4+ZnS$), magnesium silicate, basic lead silicosulphate, basic lead phosphate and aluminum silicate; and polymer particles of hollow structure (polymer pigment). The hollow polymer particles are made of a styrene polymer or a styrene-acrylic copolymer, and the outer diameter thereof is in the range of 0.2–1 μm and the diameter of hollow (inner diameter) is in the range of 0.05–0.7 μm, as described in U.S. patent application Ser. No. 940,416. Among these materials, preferred are $Al_2O_3$, $ZrO_2$, $TiO_2$, $BaSO_4$, $SiO_2$, ZnS, ZnO and $M^{II}FX$ (wherein $M^{II}$ and X have the same meanings as defined above). The light-reflecting materials may be employed singly or in the combination of two or more of them.

The coating dispersion-I is prepared by adding particles of the light-reflecting material and a binder to an appropriate solvent and mixing them. As For the binder and the solvent, there can be employed binders and solvents employable in a coating dispersion-II for the preparation of the stimulable phosphor layer, as described hereinbelow. When the light-reflecting material is hollow polymer particles, the binder may be an aqueous polymer such as an ester of acrylic acid copolymer. The coating dispersion-I may further contain a variety of additives such as a dispersing agent, a plasticizer and a colorant.

The ratio between the binder and the light-reflecting material in the coating dispersion-I is generally within the range of from 2:1 to 1:20 (binder:material, in volume). The ratio therebetween is preferably within the range of from 1:1 to 1:5, in volume, from the viewpoint of the adhesion between a support and the light-reflecting layer.

In the second place, a coating dispersion-II in which stimulable phosphor particles are homogeneously dispersed in a binder solution is prepared for the formation of the stimulable phosphor layer.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–900 nm.

Examples of the stimulable phosphor employable in the invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, BaO.x$Al_2O_3$:Eu, in which x is a number satisfying the condition of $0.8 \leqq x \leqq 10$, and $M^{2+}$O.xSi$O_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$ and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in U.S. Pat. No. 4,239,968;

$M^{II}FX.xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br and I; and x and y are numbers satisfying the conditions of $5 \times 10^{-5} \leqq x \leqq 0.5$ and $0<y \leqq 0.2$, respectively, as described in Japanese Patent Provisional Publication No. 55(1980)-160078;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 10^{-2}$, respectively, as described in Japanese Patent Provisional Publication No. 56(1981)-116777;

$(Ba_{1-x},M^{II}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 2 \times 10^{-1}$, respectively, as described in Japanese Patent Provisional Publication No. 57(1982)-23673;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0<z \leqq 5 \times 10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0<x<0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yb, Lu, Al, Ga, In and Tl; X is at least one halogen selected from the group consisting of Cl, Br and I; and x and y are numbers satisfying the conditions of $10^{-2} \leqq x \leqq 0.5$ and $0<y \leqq 0.1$, respectively, as described in U.S. patent application Ser. No. 841,044;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6} \leqq x \leqq 0.1$ and $0<y \leqq 0.1$, respectively, as described in U.S. patent application No. 520,215;

$BaFX.xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6} \leqq x \leqq 0.1$ and $0 < y \leqq 0.1$, respectively, as described in U.S. patent application Ser. No. 502,648;

$BaFX.xNaX':aEu^{2+}$, in which each of X and X' is at least one halogen selected from the group consisting of Cl, Br and I; and x and a are numbers satisfying the conditions of $0 < x \leqq 2$ and $0 < a \leqq 0.2$, respectively, as described in Japanese Patent Provisional Publication No. 59(1984)-56479;

$M^{II}FX.xNaX':yEu^{2+}:zA$, in which $M^{II}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0 < x \leqq 2$, $0 < y \leqq 0.2$ and $0 < z \leqq 10^{-2}$, respectively, as described in U.S. Pat. No. 4,505,989; and $M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is at least one metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0 \leqq a \leqq 2$, $0 \leqq b \leqq 10^{-2}$, $0 \leqq c \leqq 10^{-2}$ and $a+b+c \geqq 10^{-6}$; and x and y are numbers satisfying the conditions of $0 < x \leqq 0.5$ and $0 < y \leqq 0.2$, respectively, as described in U.S. patent application Ser. No. 857,512;

$M^{II}X_2.aM^{II}X'_2:xEu^{2+}$, in which $M^{II}$ is at least one alkaline earth metal selected from the group consisting of Ba, Sr and Ca; each of X and X' is at least one halogen selected from the group consisting of Cl, Br and I, and $X \neq X'$; and a and x are numbers satisfying the conditions of $0.1 \leqq a \leqq 10.0$ and $0 < x \leqq 0.2$, respectively, as described in U.S. patent application Ser. No. 834,886;

$M^{II}FX.aM^{I}X':xEu^{2+}$, in which $M^{II}$ is at least one alkaline earth metal selected from the group consisting of Ba, Sr and Ca; $M^{I}$ is at least one alkali metal selected from the group consisting of Rb and Cs; X is at least one halogen selected from the group consisting of Cl, Br and I; X' is at least one halogen selected from the group consisting of F, Cl, Br and I; and a and x are numbers satisfying the conditions of $0 < a \leqq 4.0$ and $0 < x \leqq 0.2$, respectively, as described in U.S. patent application Ser. No. 814,028; and $M^{I}X:xBi$, in which $M^{I}$ is at least one alkali metal selected from the group consisting of Rb and Cs; X is at least one halogen selected from the group consisting of Cl, Br and I; and x is a number satisfying the condition of $0 < x \leqq 0.2$, as described in U.S. patent application Ser. No. 846,919.

The $M^{II}X_2.aM^{II}X'_2:xEu^{2+}$ phosphor described in U.S. patent application Ser. No. 660,987 may further contain the following additives in the following amount to 1 mol. of $M^{II}X_2.aM^{II}X'_2$:

$bM^{I}X''$, in which $M^{I}$ is at least one alkali metal selected from the group consisting of Rb and Cs; X'' is at least one halogen selected from the group consisting of F, Cl, Br and I; and b is a number satisfying the condition of $0 < b \leqq 10.0$, as described in U.S. patent application Ser. No. 699,325;

$bKX''.cMgX'''_2.dM^{III}X''''_3$, in which $M^{III}$ is at least one trivalent metal selected from the group consisting of Sc, Y, La, Gd and Lu; each of X'', X''' and X'''' is at least one halogen selected from the group consisting of F, Cl, Br and I; and b, c and d are numbers satisfying the conditions of $0 \leqq b \leqq 2.0$, $0 \leqq c \leqq 2.0$ and $0 \leqq d \leqq 2.0$, and $2 \times 10^{-5} \leqq b+c+d$, as described in U.S. patent application Ser. No. 847,631;

bA, in which A is at least one oxide selected from the group consisting of $SiO_2$ and $P_2O_5$; and b is a number satisfying the condition of $10^{-4} \leqq b \leqq 2 \times 10^{-1}$, as described in U.S. patent application Ser. No. 727,972;

yB, in which y is a number satisfying the condition of $2 \times 10^{-4} \leqq b \leqq 2 \times 10^{-1}$, as described in U.S. patent application Ser. No. 727,974;

bSiO, in which b is a number satisfying the condition of $0 < b \leqq 3 \times 10^{-2}$, as described in U.S. patent application Ser. No. 797,971;

$bSnX''_2$, in which X'' is at least one halogen selected from the group consisting of F, Cl, Br and I; and b is a number satisfying the condition of $0 < b \leqq 10^{-3}$, as described in U.S. patent application Ser. No. 797,971;

$bCsX''.cSnX'''_2$, in which each of X'' and X''' is at least one halogen selected from the group consisting of F, Cl, Br and I; and b and c are numbers satisfying the conditions of $0 < b \leqq 10.0$ and $10^{-6} \leqq c \leqq 2 \times 10^{-2}$, respectively, as described in U.S. patent application Ser. No. 850,715; and $bCsX''.yLn^{3+}$, in which X'' is at least one halogen selected from the group consisting of F, Cl, Br and I; Ln is at least one rare earth element selected from the group consisting of Sc, Y, Ce, Pr, Nd, Sm, Gd, Tb, Dy, Ho, Er, Tm, Yb and Lu; and b and y are numbers satisfying the conditions of $0 < b \leqq 10.0$ and $10^{-6} \leqq y \leqq 1.8 \times 10^{-1}$, respectively, as described in U.S. patent application Ser. No. 850,715.

Among the above-described stimulable phosphors, the divalent europium activated alkaline earth metal halide phosphor and rare earth element activated rare earth oxyhalide phosphor are particularly preferred, because these show stimulated emission of high luminance. The above-described stimulable phosphors are given by no means to restrict the stimulable phosphor employable in the present invention. Any other phosphors can be also employed, provided that the phosphor gives stimulated emission when excited with stimulating rays after exposure to a radiation.

Examples of the binder include: natural polymers such as proteins (e.g. gelatin), polysaccharides (e.g. dextran) and gum arabic; and synthetic polymers such as polyvinyl butyral, polyvinyl acetate, nitrocellulose, ethylcellulose vinylidene chloride-vinyl chloride copolymer, polyalkyl (meth)acrylate, vinyl chloride-vinyl acetate copolymer, polyurethane, cellulose acetate butyrate, polyvinyl alcohol and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate. These binders may be crosslinked with a crosslinking agent.

Examples of the solvent employable in the preparation of the coating dispersion-II include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monomethyl ether; and mixtures of the above-mentioned compounds.

The coating dispersion-II is prepared by adding the stimulable phosphor particles and the binder to the solvent and sufficiently mixing them.

The ratio between the binder and the stimulable phosphor in the coating dispersion-II may be determined according to the characteristics of the aimed radiation image storage panel and the nature of the phosphor employed. Generally, the ratio therebetween is within the range of from 5:1 to 1:20 (binder:phosphor, in volume), preferably from 1:1 to 1:10, in volume.

The coating dispersion-II may contain a variety of additives such as a dispersing agent to improve the dispersibility of the phosphor particles therein and a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion-II may further contain such a colorant that the mean reflectance thereof in the wavelength region of stimulating rays for the stimulable phosphor is lower than the mean reflectance thereof in the wavelength region of light emitted by the stimulable phosphor upon excitation thereof, to enhance the sharpness of an image provided by the resulting panel. Examples of the colorant include those disclosed in U.S. Pat. No. 4,394,581 and U.S. patent application Ser. No. 326,642. The coating dispersion-II may contain such a white powder as described in U.S. Pat. No. 4,350,893 for the same purpose.

The binder employed in the coating dispersion-I may or may not be compatible with the binder employed in the coating dispersion-II. From the viewpoint of the mechanical strength (such as adhesion), both binders are preferably compatible with each other and more preferably the same. The solvent employed in the coating dispersion-I may be the same or different from the solvent employed in the coating dispersion-II. Both solvents are desired to be miscible with each other in order to dry superposed layers of the coating dispersions-I and II at the same speed.

The coating dispersion-I and the coating dispersion-II are evenly applied onto the surface of a support at one time and in the superposed form, wherein the coating dispersion-I is arranged to be placed on the support, to form layers of the coating dispersions-I and II. The applying procedure is conducted, for instance by using a twin-hopper type coating apparatus. Otherwise, the coating dispersion-I is first applied onto the surface of the support and then, the coating dispersion-II is immediately applied thereonto while preventing the solvent of the dispersion-I from releasing, to form layers of the dispersions-I and II. The application procedure is conducted, for instance by using a doctor blade, a roll coater or a knife coater.

The ratio between the coating amount of the dispersion-I and the coating amount of the dispersion-II varies depending on the characteristics of the aimed radiation image storage panel, the viscosity of the coating dispersions, the ratio between the binder and the light-reflecting material, the ratio between the binder and the stimulable phosphor, etc. Generally, the ratio therebetween is within the range of from 2:1 to 1:40 (dispersion-I:dispersion-II, in volume), preferably from 1:1 to 1:20.

After applying the coating dispersion-I and the coating dispersion-II to the support, the layer of the dispersion-I on the support side and the layer of the dispersion-II provided thereon are together heated slowly to dryness in a simultaneous stage, so as to complete the formation of a light-reflecting layer and a stimulable phosphor layer. When both binders of the dispersions-I and II are compatible with each other, it is confirmed that the formed layers can not be distinguished by an interface (boundary) in usual even when visually observing with an electron microscope.

The light-reflecting layer and the stimulable phosphor layer can be provided on the support by the methods other than that given in the above. For instance, the phosphor layer and the light-reflecting layer are initially formed on a sheet (false support) such as glass plate, metal plate or plastic sheet by applying both coating dispersions thereonto in the superposed form as described above, in such a manner that the dispersion-II is arranged to be placed on the sheet, and then the formed phosphor layer and light-reflecting layer are laminated on the genuine support by pressing or using an adhesive agent.

The thickness of the light-reflecting layer and the thickness of the stimulable phosphor layer vary depending upon the characteristics of the aimed radiation image storage panel, the nature of the phosphor, the ratio between the binder and the light-reflecting material, the ratio between the binder and the phosphor, etc. The thickness of the light-reflecting layer is preferably within the range of from 5 to 100 $\mu$m. The thickness of the phosphor layer is generally within the range of from 20 $\mu$m to 1 mm, and preferably from 50 to 500 $\mu$m.

The support material employed in the invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black.

On the support, a subbing layer may be provided by coating a polymer material such as gelatin to enhance the adhesion between the support and the light-reflecting layer. Otherwise, an antistatic layer comprising a conductive material such as $In_2O_3$ or $SnO_2$ may be provided on the support to improve the antistatic properties of the panel.

As described in U.S. patent application Ser. No. 496,278, the light-reflecting layer-side surface of the support (or the surface of a subbing layer or antistatic layer in the case that such layers are provided on the support) may be provided with protruded and depressed parts for enhancement of the sharpness of the image.

On the stimulable phosphor layer, a transparent protective film may be provided to protect the phosphor layer from physical and chemical deterioration.

The transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. Alternatively, the transparent film can be provided onto the phosphor layer by beforehand preparing it from a polymer such as polyethylene terephthalate, polyethylene, polyvinylidene chloride or polyamide, followed by placing and fixing it onto the phosphor layer with an appropriate adhesive agent. The transparent protective film preferably has a thickness within the range of approximately 0.1 to 20 μm.

The following examples further illustrate the present invention, but these examples are by no means understood to restrict the invention.

EXAMPLE 1

Aluminum oxide particles ($Al_2O_3$, average diameter: 1.0 μm), a binder composed of polyalkyl (meth)acrylate, isocyanate and nitrocellulose (nitration degree: 11.5%) and tricresyl phosphate (plasticizer) were added to methyl ethyl ketone. The mixture was stirred by means of a propeller agitator to prepare a dispersion of the white pigment [coating dispersion-I] having a mixing ratio of 2:1 (binder:pigment, in volume) and a viscosity of 25–35 PS (25° C.).

Independently, divalent europium activated barium fluorobromide ($BaFBr:Eu^{2+}$) stimulable phosphor particles, the above binder and plasticizer were added to methyl ethyl ketone. The mixture was stirred by means of a propeller agitator to prepare a dispersion of the stimulable phosphor [coating dispersion-II] having a mixing ratio of 1:4 (binder:phosphor, in volume) and a viscosity of 25–35 PS (25° C.).

The coating dispersion-I was evenly applied onto a polyethylene terephthalate sheet containing carbon black (support, thickness: 250 μm, trade name: X-30, available from Toray Industries, Inc.) placed horizontally on a glass plate by using a doctor blade. Immediately, the coating dispersion-II was applied superposedly on the layer of the coating dispersion-I in the same manner so as to prevent the solvent in the dispersion-I from releasing.

After the coating was complete, the support having the coating dispersion-I and the coating dispersion-II was placed in an oven and heated at a temperature gradually rising from 25° to 100° C., to form a light-reflecting layer having a thickness of 30 μm and a stimulable phosphor layer having a thickness of 250 μm on the support.

It was confirmed from a sectional photograph obtained by using a scanning electron microscope with respect to the light-reflecting layer and the stimulable phosphor layer provided on the support that the interface therebetween was not clear.

On the stimulable phosphor layer was placed a transparent polyethylene terephthalate film (protective film, thickness: 10 μm, provided with a polyester adhesive layer on the surface) to combine the transparent film and the phosphor layer with the adhesive layer.

Thus, a radiation image storage panel consisting essentially of a support, a light-reflecting layer, a stimulable phosphor layer and a protective film, superposed in this order was prepared.

Further, a variety of radiation image storage panels in which the phosphor layers varied in thickness from 100 to 300 μm were prepared.

EXAMPLE 2

The procedure of Example 1 was repeated except for varying the mixing ratio between the binder and the white pigment in the coating dispersion-I to 1:1, in volume to prepare a variety of radiation image storage panels consisting essentially of a support, a light-reflecting layer, a stimulable phosphor layer and a protective film, superposed in this order, in which the phosphor layers varied in thickness from 100 to 300 μm.

EXAMPLE 3

The procedure of Example 1 was repeated except for varying the mixing ratio between the binder and the white pigment in the coating dispersion-I to 1:5, in volume to prepare a variety of radiation image storage panels consisting essentially of a support, a light-reflecting layer, a stimulable phosphor layer and a protective film, superposed in this order, in which the phosphor layers varied in thickness from 100 to 300 μm.

EXAMPLE 4

The procedure of Example 1 was repeated except for varying the mixing ratio between the binder and the white pigment in the coating dispersion-I to 1:10, in volume to prepare a variety of radiation image storage panels consisting essentially of a support, a light-reflecting layer, a stimulable phosphor layer and a protective film, superposed in this order, in which the phosphor layers varied in thickness from 100 to 300 μm.

COMPARISON EXAMPLE 1

The procedure of Example 1 was repeated except for using only the coating dispersion-II to form a stimulable phosphor layer having a thickness of 300 μm directly on a support, to prepare a radiation image storage panel consisting essentially of a support, a stimulable phosphor layer and a protective film, superposed in this order.

COMPARISON EXAMPLE 2

The coating dispersion-I of Example 1 was applied onto a support using a doctor blade and then, the support having the coating dispersion-I was placed in an oven and heated at a temperature gradually rising from 25° to 100° C. to form a light-reflecting layer having a thickness of 30 μm on the support.

Subsequently, the coating dispersion-II of Example 1 was applied onto the light-reflecting layer and then dried in the above-described manner to form a stimulable phosphor layer having a thickness of 300 μm.

A transparent protective film was provided on the stimulable phosphor layer in the same manner as described in Example 1, to prepare a radiation image storage panel consisting essentially of a support, a light-reflecting layer, a stimulable phosphor layer and a protective film, superposed in this order. Further, a variety of radiation image storage panels in which the phosphor layers varied in thickness from 100 to 300 μm were prepared.

COMPARISON EXAMPLE 3

The procedure of Comparison Example 2 was repeated except for varying the mixing ratio between the binder and the white pigment in the coating dispersion-I to 1:1, in volume to prepare a variety of radiation image storage panels consisting essentially of a support, a light-reflecting layer, a stimulable phosphor layer and a protective film, superposed in this order, in which the phosphor layers varied in thickness from 100 to 300 μm.

COMPARISON EXAMPLE 4

The procedure of Comparison Example 2 was repeated except for varying the mixing ratio between the binder and the white pigment in the coating dispersion-I to 1:5, in volume to prepare a variety of radiation image storage panels consisting essentially of a support, a light-reflecting layer a stimulable phosphor layer and a protective film, superposed in this order, in which the phosphor layers varied in thickness from 100 to 300 μm.

Thus prepared radiation image storage panels were evaluated on the sensitivity thereof and the quality of the image provided thereby according to the following tests.

(1) Sensitivity

The radiation image storage panel was exposed to X-rays at voltage of 80 KVp and subsequently excited with a He-Ne laser beam (wavelength: 632.8 nm) to measure the sensitivity thereof. The evaluation on the sensitivity was done by the thickness of the stimulable phosphor layer which was needed to obtain the same sensitivity as that of the panel of Comparison Example 1 (which had only the phosphor layer in 300 μm thick), being a basic level.

(2) Image quality

The radiation image storage panel was exposed to X-rays at voltage of 80 KVp and subsequently scanned with the He-Ne laser beam. The light emitted by the stimulable phosphor layer of the panel was detected and converted to electric signals by means of a photosensor (photomultiplier having spectral sensitivity of type S-5). From the electric signals a radiation image was reproduced and recorded as a visible image on an ordinary photographic film by means of a film scanner. The visible image was observed with eyes to evaluate whether air bubbles appeared as an image to cause the lowering of the image quality (unevenness of the image density) or not. The results of the evaluation were marked by the following four levels of A, B, C and D.

A: The lowering of the image quality was never caused.

B: The lowering of the image quality was slightly caused.

C: The lowering of the image quality was so caused as to be unacceptable in practical use.

D: The lowering of the image quality was prominently caused.

The results on the evaluation are shown in Table 1.

TABLE 1

| | Sensitivity (Thickness of Phosphor Layer) | Lowering of Image |
|---|---|---|
| Example | | |
| 1 | 250 μm | A |
| 2 | 200 μm | A |
| 3 | 180 μm | A |
| 4 | 170 μm | A |
| Com. Example | | |
| 1 | 300 μm | A |
| Com. Example | | |
| 2 | 250 μm | B |
| 3 | 200 μm | C |
| 4 | 180 μm | D |

As is evident from Table 1, with respect to the radiation image storage panels prepared by the simultaneous superposition-coating method of the present invention (Examples 1 to 4), bubbles did not occur on the interface between the light-reflecting layer and the stimulable phosphor layer, or if occurred, the bubbles did not cause the lowering of the image quality, so that the panels provided the image of good quality.

On the contrary, the radiation image storage panels prepared by the conventional successive coating method (Comparison Examples 2 to 4) provided the image in which the quality was lowered owing to bubbles occurring on the interface between the light-reflecting layer and the phosphor layer.

Further, the radiation image storage panels according to the invention had higher sensitivity than the known radiation image storage panel having no light-reflecting layer (Comparison Example 1) and provided the image of the same quality as that of the known panel.

We claim:

1. A process for the preparation of a radiation image storage panel which comprises a support, a light-reflecting layer and a stimulable phosphor layer, superposed in the foregoing order, wherein a binder solution-I containing a binder and a light-reflecting material in the range of 2:1 to 1:20 in volume and a binder solution II containing a binder and a stimulable phosphor in the range of 5:1 to 1:20 in volume are applied simultaneously onto a surface of a support in such manner that both binder solutions are superposed and the binder solution-I is arranged on the support side to form a light-reflecting layer and a stimulable phosphor layer.

2. The process as claimed in claim 1, in which the ratio between the binder and the light-reflecting material in the binder solution-I ranges from 1:1 to 1:5, in volume.

3. The process as claimed in claim 1, in which the ratio between the binder and the stimulable phosphor in the binder solution-II ranges from 1:1 to 1:10, in volume.

4. The process as claimed in claim 1, in which the ratio between the amount of the binder solution-I and the amount of the binder solution-II ranges from 2:1 to 1:40, in volume.

5. The process as claimed in claim 4, in which the ratio between the amount of the binder solution-I and the amount of the binder solution-II ranges from 1:1 to 1:20, in volume.

6. The process as claimed in claim 1, in which said light-reflecting material is at least one white pigment selected from the group consisting of $Al_2O_3$, $ZrO_2$, $TiO_2$, $BaSO_4$, $SiO_2$, ZnS, ZnO and $M^{II}FX$, wherein $M^{II}$ is at least one element selected from the group consisting of Ba, Ca and Sr; and X is Cl and/or Br.

7. The process as claimed in claim 1, in which the binder of the binder solution-I is compatible with the binder of the binder solution-II.

8. The process as claimed in claim 1, in which a solvent in the binder solution-I is miscible with a solvent in the binder solution-II.

9. A process for the preparation of a radiation image storage panel which comprises a support, a light-reflecting layer and a stimulable phosphor layer, superposed in the foregoing order, wherein a binder solution-I containing a binder and a light-reflecting material in the range of 2:1 to 1:20 in volume and a binder solution-II containing a binder and a stimulable phosphor in the range of 5:1 to 1:20 in volume are applied simultaneously onto a surface of a plane sheet in such manner that both binder solutions are superposed and the binder solution-I is arranged on the sheet side to form a light-reflecting layer and a stimulable phosphor layer; both layers are then separated from the sheet and combined with a support in such manner that the light-reflecting layer faces the support.

10. The process as claimed in claim 9, in which the ratio between the binder and the light-reflecting material in the binder solution-I ranges from 1:1 to 1:5, in volume.

11. The process as claimed in claim 9, in which the ratio between the binder and the stimulable phosphor in the binder solution-II ranges from 1:1 to 1:10, in volume.

12. The process as claimed in claim 9, in which the ratio between the amount of the binder solution-I and the amount of the binder solution-II ranges from 2:1 to 1:40, in volume.

13. The process as claimed in claim 12, in which the ratio between the amount of the binder solution-I and the amount of the binder solution-II ranges from 1:1 to 1:20, in volume.

14. The process as claimed in claim 9, in which said light-reflecting material is at least one white pigment selected from the group consisting of $Al_2O_3$, $ZrO_2$, $TiO_2$, $BaSO_4$, $SiO_2$, ZnS, ZnO and $M^{II}FX$, wherein $M^{II}$ is at least one element selected from the group consisting of Ba, Ca and Sr; and X is Cl and/or Br.

15. The process as claimed in claim 9, in which the binder of the binder solution-I is compatible with the binder of the binder solution-II.

16. The process as claimed in claim 9, in which a solvent in the binder solution-I is miscible with a solvent in the binder solution-II.

* * * * *